US007150173B2

(12) United States Patent
Lonero

(10) Patent No.: US 7,150,173 B2
(45) Date of Patent: Dec. 19, 2006

(54) UPPER AND LOWER TOOLS FOR DEEP ROLLING

(75) Inventor: Vincent J. Lonero, Naples, FL (US)

(73) Assignee: Lonero Engineering Company, Inc., Troy, MI (US)

( * ) Notice: Subject to any disclaimer, the term of this patent is extended or adjusted under 35 U.S.C. 154(b) by 187 days.

(21) Appl. No.: 10/840,995

(22) Filed: May 6, 2004

(65) Prior Publication Data

US 2004/0231383 A1 Nov. 25, 2004

Related U.S. Application Data

(60) Provisional application No. 60/471,899, filed on May 20, 2003.

(51) Int. Cl.
*B21D 15/00* (2006.01)

(52) U.S. Cl. ..... 72/110

(58) Field of Classification Search ..... 72/107, 72/110, 111, 115, 120, 125, 447, 237, 238; 29/6.01

See application file for complete search history.

(56) References Cited

U.S. PATENT DOCUMENTS 4,559,798 A * 12/1985 Hayashi et al. ..... 72/81
4,766,753 A * 8/1988 Berstein et al. ..... 72/110
6,094,956 A * 8/2000 Vodopyanov et al. ..... 72/110
6,786,073 B1 * 9/2004 Bone ..... 72/110

* cited by examiner

*Primary Examiner*—Ed Tolan
(74) *Attorney, Agent, or Firm*—Raggio & Dinninm P.C.

(57) ABSTRACT

The present invention includes a plurality of substantially similar deep rolling tools that are positionable radially about a workpiece. The plurality of tools is preferably oriented in a substantially coplanar fashion. At least one of the tools is movable relative to the other tools, thereby allowing delivery or removal of the workpiece, for example an automotive crankshaft, for deep rolling thereof.

19 Claims, 3 Drawing Sheets

UPPER AND LOWER TOOLS FOR DEEP ROLLING

This Application claims the Benefit of the Filing Date of United Sates Provisional Patent Application Ser. No. 60/471,899, Filed May 20, 2003.

TECHNICAL FIELD

The present invention relates broadly to deep rolling tools and processes for deep rolling fillets of engine crankshafts or annular areas in other metallic work pieces subject to high stress loads. In particular, the invention will relate to an improved upper and lower tool design for deep rolling wherein a plurality of tool assemblies are positioned about the subject work piece.

BACKGROUND OF THE INVENTION

The state of the art is exemplified by the following references: Gottschalk U.S. Pat. No. 5,495,738; Gottschalk, et al. U.S. Pat. No. 5,445,003; Bone U.S. Pat. No. 5,493,761; Wilkens U.S. Pat. No. 5,138,859; Betsrein U.S. Pat. No. 4,561,276; Ostertag U.S. Pat. No. 4,947,668.

In many modern day automobiles, engines are downsized for installation into relatively smaller new vehicles. Other automotive components such as crankshafts and camshafts are being downsized to accommodate smaller engines, as well as to reduce weight and improve fuel efficiency. This downsizing of components can sometimes result in compromises in strength and durability, as compared with older, larger engine components. In particular, there is a need to improve the strength and durability of downsized crankshafts. The fatigue strength and durability of crank pins and main bearing journals can be significantly increased by various manufacturing processes.

A wide variety of machines and processes is known in the art for strengthening and finishing metallic work pieces such as crankshafts and camshafts. In particular, it is known to "deep roll" or press an annular groove about the circumference of a crankshaft at points where a cam lobe joins with the shaft. In a typical process, a crankshaft or similar elongate workpiece is engaged with a deep rolling tool. Force is applied to press a roller of the tool, known in the art as a "work roll," against the shaft of the crankshaft as the crankshaft is rotated. The force of the work roll causes compressive stresses on the shaft, deforming the shaft circumferentially, and forming an annular groove therein. In one example of such an application, the work roll(s) is/are applied in the middle of the annular fillets between the pin journals and adjacent counter weights or balancing webs. Such deformation or pre-stressing of the crankshaft/camshaft has been shown to significantly improve the strength and/or durability of the workpiece.

Known processes/assemblies often utilize a single upper, deep rolling tool, positioned opposite a "lower tool." The purpose of the lower tool is to support the side of the shaft opposite the point at which the force is applied via the work roll(s). These systems have worked quite well over the years, however, utilizing two separate types of tool, i.e. the deep rolling tool and the lower tool, for carrying out the deep rolling process is not without drawbacks. Various lower tool designs are known in the art, however many known designs are relatively complex. The use of separate tools can also require separate maintenance, inspection, repair and cleaning tasks for each tool. Moreover, in conventional designs having a single deep rolling tool, one complete turn of the workpiece shaft is necessary to apply the work roll against the entire circumference of the shaft to be treated, sometimes necessitating many, relatively time-consuming rotations of the shaft before the workpiece is suitably processed. Even modest improvements in design and processing efficiency are often welcomed by the industry.

It is an object of the present invention to provide a novel design for improving deep rolling tool performance and processing time.

Other objects, features and advantages of the present invention will become apparent upon an examination of the accompanying drawing figures, following detailed description and appended claims.

SUMMARY OF THE INVENTION

The present invention includes a plurality of substantially similar deep rolling tools that are positionable radially about a workpiece. The plurality of tools is preferably oriented in a coplanar fashion and engaging their respective work rolls substantially simultaneously about annular areas of the workpiece. At least one of the tools is movable relative to the other tools, thereby allowing delivery or removal of the workpiece, for example an automotive crankshaft, for deep rolling thereof.

DETAILED DESCRIPTION

Figure 1:
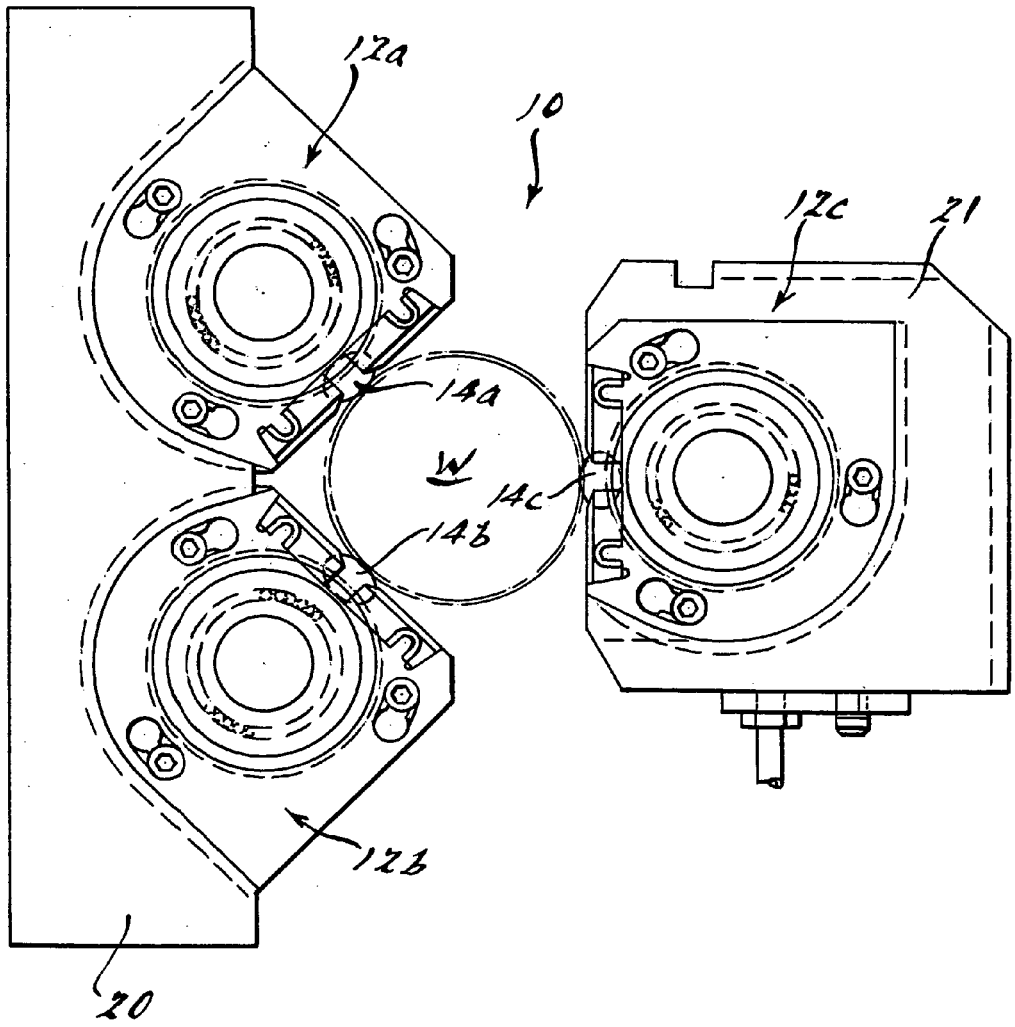
FIG. 1 is a side view of a deep rolling tool assembly in accordance with a preferred embodiment of the present invention.

Referring to FIG. 1, there is shown a deep rolling tool assembly 10 in accordance with a preferred embodiment of the present invention. Assembly 10 preferably includes three individual deep rolling tools 12*a–c*, positioned about a workpiece, for example, an automotive crankshaft "W". In a preferred embodiment, three substantially identical deep rolling tools are included in assembly 10, however, other embodiments are contemplated (for example for workpieces having a larger diameter than a crankshaft), in which more than three deep rolling tools are used. The three tools 12*a–c* are preferably positioned substantially radially symmetrically about crankshaft W, and engage crankshaft W with work rolls 14*a–c* substantially simultaneously. During a deep rolling operation, mechanical force is applied to one or more of tools 12*a–c*, urging the tool(s) inwardly against crankshaft W. Crankshaft W is preferably rotated, and work rolls 14*a–c* form a compression groove circumferentially about crankshaft W.

Figure 2:
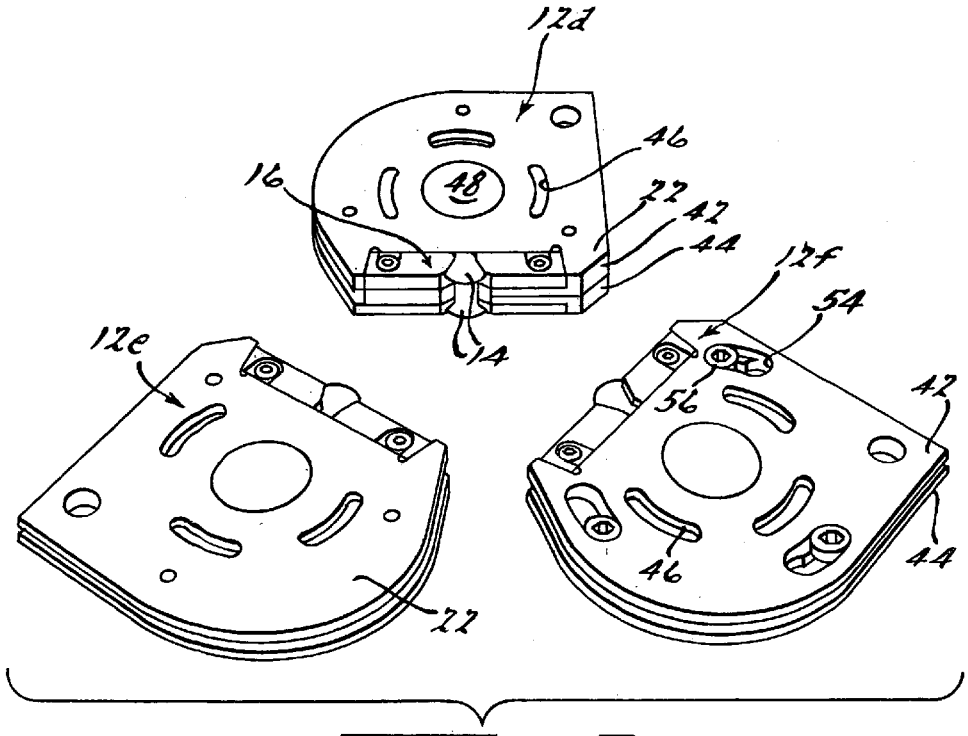
FIG. 2 is a perspective view of a deep rolling tool assembly similar to that pictured in FIG. 1.
Figure 3:
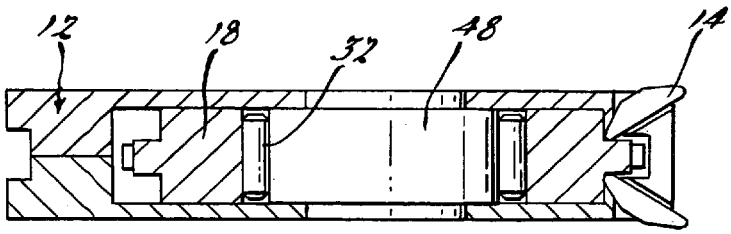
FIG. 3 is a sectioned end view of a deep rolling tool similar to the deep rolling tools pictured in FIGS. 1 and 2.
Figure 4:
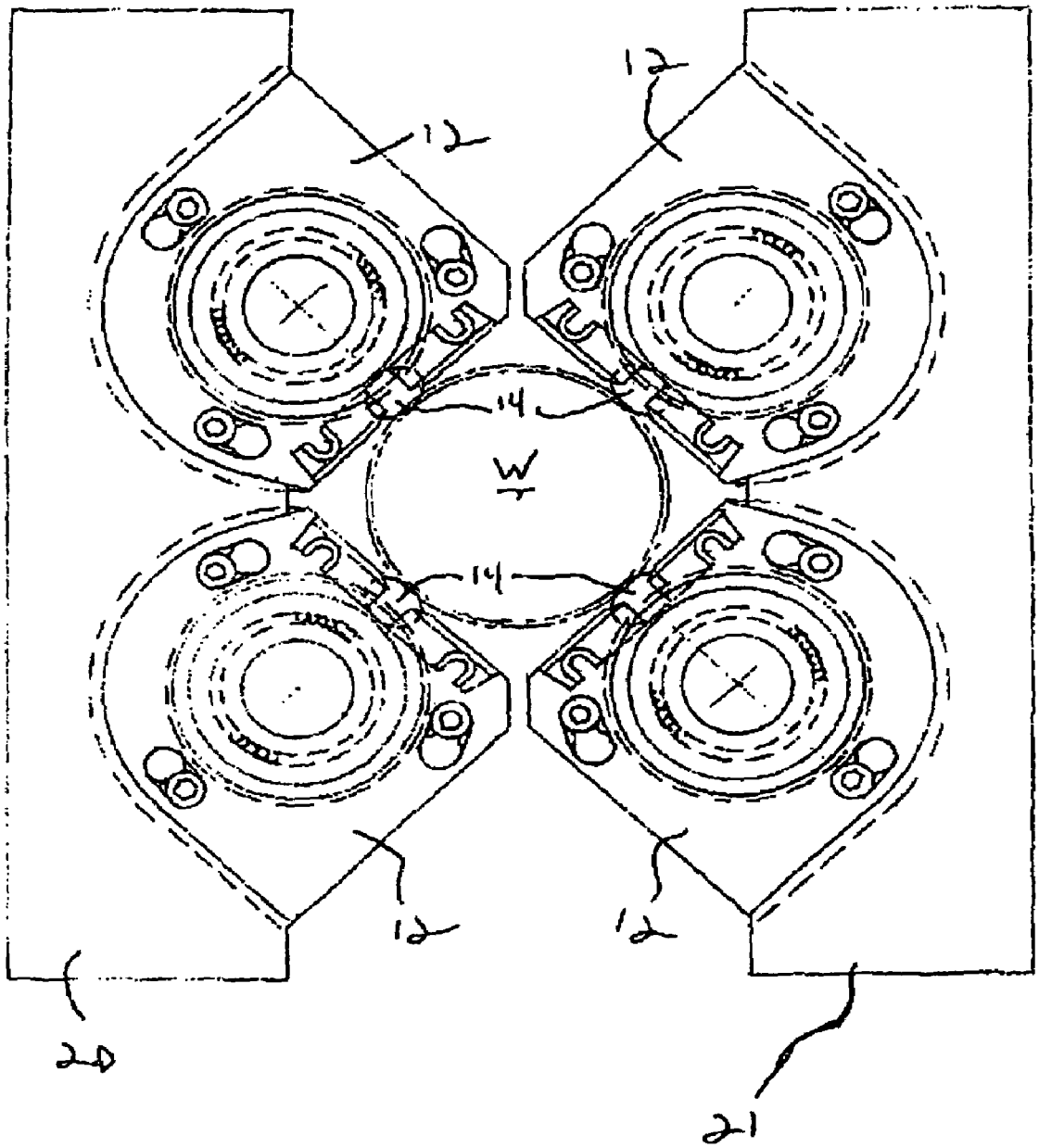
FIG. 4 is a side view of a deep rolling tool assembly according to an alternate embodiment of the present invention.

Referring also to FIG. 2, there is shown a perspective view of a plurality of deep rolling tool bodies 12*d–f* suitable for use with assembly 10. Each tool body 12*d–f* includes a housing or casing 22, preferably a two-piece casing, that houses a back-up roller (not shown in FIG. 2) which rotatively supports a pair of work rolls 14 in a conventional manner, rotating about a shaft 48 fixed within the housing. Work rolls 14 are preferably formed from relatively hard steel, and are preferably substantially conventional disc-shaped work rolls. A cage 16, any suitable one or multi-piece cage, is attached to casing 22, and retains work rolls 14. The tool bodies 12 shown in FIGS. 1 and 2 are of the twist type, preferably having first 42 and second 44 complementary housing portions. Tm a preferred embodiment, the housing portions are rotatable relative to one another between a locked, and an unlocked position. One of the housing portions, for example first housing portion 42, preferably includes a plurality of arcuate cutouts 54, that receive fasteners 56 extending from the other housing portion 44. Relative rotation between the housing portions preferably positions fasteners 56 at either end of cutouts 54, alternately between a first position at which the heads of fasteners 56 prevent separation of the housing portions, and a second position at which the housing portions are separable. Tool bodies 12*d–f* may further include a plurality of radially arranged openings 46 for cleaning, cooling and/or lubrication of the internal components, in either of housing portions 42 and 44. A full description of the twist tools used herein may be found in Applicant's U.S. patent application entitled "Two Piece Upper Tool," filed Apr. 8, 2004, having Ser. No. 10/821,682, and incorporated by reference herein. Turning to FIG. 3, there is shown a sectioned view of a deep rolling tool 12 similar to the tools pictured in FIGS. 1 and 2. For simplicity, the features of the FIG. 3 illustration that are similar to features in the FIG. 2 illustration are identified with identical numbers. FIG. 3 illustrates the back-up roller 18, which rotates on a ring bearing 32 about a shaft 34. As pictured, work rolls 14 engage back-up roller 18, and preferably rotate therewith during operation of the tool. The tools described herein preferably include a pair of work rolls, which are spaced such that each tool forms (or assists in forming) a pair of evenly spaced, compressed grooves about crankshaft W, however, it is contemplated that alternative embodiments (not shown) would employ tools having only a single work roll. Those skilled in the art will appreciate that any suitable deep rolling tool might be utilized in assembly 10, and the present description should not be taken as limiting.

Returning to FIG. 1, in a preferred embodiment, tools 12*a–c* are substantially coplanar such that work rolls 14*a–c* are all engageable with crankshaft W in substantially the same plane, or where two work rolls are provided with each tool 12, two planes. It should be noted that tools 12*a–c* in one contemplated embodiment are reduced size tools, i.e., "mini tools" compared to those in the prior art. These reduced size tools 12*a–c* create a more efficient and usable modular deep rolling system. Edges of the work preferably define a circle when arranged about the workpiece, and are tangent thereto. As a result, when crankshaft W is rotated, annular grooves are preferably formed circumferentially about crankshaft W by three separate sets of work rolls. Two of the tools, for example 12*a* and 12*b* as shown in FIG. 1, may be mounted in a first housing 20, while the third tool 12*c* is mounted in a separate, second housing 21. In one preferred design, first housing 20 is held substantially stationary, while second housing 21 is movable to allow crankshaft W to be delivered or removed from assembly 10. In such a design, housing 21 can be swung or lifted out of the way to allow removal or initial positioning of crankshaft W by, for example, a robot or mechanized carrier. It should be appreciated that FIG. 1 is illustrative only, and the orientation/positioning of housings 20 and 21 might be varied without departing from the scope of the present invention. For instance, housing 20 (having two tools 12*a* and 12*b*) could be positioned beneath crankshaft W, and housing 21 could be swung into position onto the top of workpiece W. Similarly, housings 20 and 21 could be oriented such that housing 21 (having a single tool) is positioned below crankshaft W, and the dual tools positioned in housing 20 swung or dropped into position from above the crankshaft W. Housings 20, 21 could also each hold two tools thus allowing for up to eight work rolls to work each workpiece. It should be noted that any known fastening means may be used to secure the tools 12*a*–12*c* into the pockets of the housings 20, 21. The pockets will be appropriately angled such that the tools 12*a*–12*c* will have the work rolls 14*a–c* properly aligned with the workpiece. It should be noted that all of the tools are similar and that they may be interchanged between one another which will allow for easy assembly and disassembly for maintenance or repair purposes. The tools 12*a–c* may be secured in the housings 20, 21 by a snap lock arrangement, keyed system, fasteners, springs, detents, and any other known fastening technique that is capable of securing one object to another. The present invention is a completely modular deep rolling mechanism that also may even have prior art lower rolls snapped or secured into the housings if the design so requires.

By positioning tools 12*a–c* in a substantially coplanar fashion, the three sets of work rolls 14*a–c* are all engaging crankshaft W simultaneously. Thus, the three sets of work rolls, each set comprising a first and second work roll, impinge upon substantially the same two annular portions of crankshaft W, i.e. a first annular portion (not shown) around which a first of each set of work rolls is aligned, and a second annular portion (also not shown) around which a second of each set of work rolls is aligned. In order to deep roll a single "pass" about the entire circumference of crankshaft W, it is only necessary to rotate the crankshaft about 120°. Thus, because of the three contact points with the sets of work rolls 14*a–c*, one full rotation of crankshaft W does approximately three times the work that is done by an assembly with only a single deep rolling tool having one set of work rolls.

As described, the multiple deep rolling tools are preferably positionable substantially symmetrically about crankshaft W. It is therefore unnecessary to utilize a conventional "lower tool" for supporting the crankshaft opposite the deep rolling tool, as in earlier designs. By using a single tool type (eliminating the passive lower tool), the diversity and complexity of parts of the entire apparatus can be reduced. Moreover, because assembly 10 preferably utilizes substantially identical deep rolling tools, maintenance costs and system downtime can be reduced since it is unnecessary to acquire, calibrate, clean, maintain, etc. two separate types of tools. Utilizing a single tool type further facilitates maintenance in that the wear time of the tools varies less than in designs where diverse tool types are used. Finally, the use of multiple deep rolling tools, all having work rolls engageable with the workpiece, substantially reduces the time necessary for deep rolling any one workpiece, accordingly reducing costs and overall processing time.

The present description is for illustrative purposes only, and should not be construed to limit the breadth of the present invention in any way. While it may be apparent that the particular disclosed embodiments are well calculated to fill benefits, objects and advantages of the invention, it should be appreciated that the present disclosure is susceptible of modification without departing from the full and fair meaning and scope of the present invention, or departing form the proper scope or fair and necessary use of the subjoined claims.

What is claimed is:

1. A deep rolling apparatus comprising:

a first and second housing;

three tool bodies arranged within said housings, said tool bodies being interchangeable with one another, said three tool bodies positionable radially about a workpiece, each said body having a back-up roller rotatively supporting at least one work roll;

at least one of said tool bodies is movable whereby said work rolls alternately disengage with the workpiece or substantially simultaneously engage the same.

2. The deep rolling apparatus of claim 1 wherein each of said tool bodies includes two work rolls.

3. The deep wiling apparatus of claim 1 wherein said housings having at least one pocket therein for supporting and receiving one of said tool bodies.

4. The deep wiling apparatus of claim 3 wherein a third of said tool bodies is movable relative to said other tool bodies.

5. The deep rolling apparatus of claim 1 wherein said tool bodies are positioned substantially radially symmetrically about the workpiece when engaged therewith.

6. The deep wiling apparatus of claim 1 comprising four tool bodies, each of said tool bodies having a back-up roller rotatively supporting at least one work roll.

7. An apparatus for deep rolling of an elongate workpiece comprising:

a plurality of similar and interchangeable reduced size tool bodies positionable in a substantially coplanar radial arrangement;

at least three work rolls rotatively supported in separate of said tool bodies for engaging against the workpiece, said work rolls oriented to contact the workpiece in a common plane.

8. The apparatus of claim 7 comprising three tool bodies.

9. The apparatus of claim 8 comprising four tool bodies.

10. The apparatus of claim 8 comprising a housing supporting a first and a second of said tool bodies.

11. The apparatus of claim 10 wherein a third of said tool bodies is movable out of said radial arrangement.

12. The apparatus of claim 11 wherein said third tool body is movable into or out of said radial arrangement while substantially coplanar with said first and second tool bodies.

13. The apparatus of claim 12 wherein said radial arrangement is a substantially radially symmetrical arrangement.

14. The apparatus of claim 7 wherein at said radial arrangement edges of said at least three work rolls define a circle and are tangent thereto.

15. A modular deep rolling apparatus comprising:

a plurality of housings having at least one pocket therein;

a plurality of tool bodies, each of said tool bodies including a back-up roller rotatable therein;

at least three work rolls, each of said work rolls rotatively supported by the back-up roller in one of said tool bodies;

said tool bodies are arranged within said pockets of said housings, said tool bodies positionable in a radial arrangement for deep rolling a workpiece, wherein at said radial arrangement said work rolls are substantially tangent to a circle defined thereby;

at least one of said tool bodies is movable from said radial arrangement.

16. The apparatus of claim 15 wherein a first housing supporting at least two of said tool bodies.

17. The apparatus of claim 16 wherein at least one of said tool bodies is movable relative to said first housing, whereby said tool bodies are positionable in a substantially coplanar, radially symmetrical arrangement, and a substantially coplanar, non-symmetrical arrangement.

18. The apparatus of claim 15 wherein said tool bodies are interchangeable between any of said pockets of said housings.

19. The apparatus of claim 15 wherein said tools having a reduced size and said tools are secured in said pockets during operation thereof, said tools are removable.

* * * * *

UNITED STATES PATENT AND TRADEMARK OFFICE

CERTIFICATE OF CORRECTION

PATENT NO. : 7,150,173 B2
APPLICATION NO. : 10/840995
DATED : December 19, 2006
INVENTOR(S) : Vincent J. Lonero It is certified that error appears in the above-identified patent and that said Letters Patent is hereby corrected as shown below:

Title Page - Please delete "Raggio & Dinninm P.C."and insert --Raggio & Dinnin, P.C. -- after "(74) Attorney, Agent Or Firm";

Col. 3, line 6, - Please delete "Tm"and insert --In -- after "housing portions";

Col. 4, Line 66, - Please delete "form"and insert --from-- before "the proper scope";

Col. 5, Line 14, Claim 3 - Please delete "wiling"and insert --rolling -- after "The deep";

Col. 5, Line 17, Claim 4 - Please delete "wiling"and insert --rolling -- after "The deep";

Col. 5, Line 22, Claim 6 - Please delete "wiling"and insert --rolling -- after "The deep";

Signed and Sealed this

Third Day of April, 2007

JON W. DUDAS
*Director of the United States Patent and Trademark Office*